US010024099B2

(12) United States Patent
Abramson et al.

(10) Patent No.: US 10,024,099 B2
(45) Date of Patent: Jul. 17, 2018

(54) DRAFT GUARD

(71) Applicants: Steven Robert Abramson, Victor, NY (US); Gavin Patrick Abramson, Victor, NY (US)

(72) Inventors: Steven Robert Abramson, Victor, NY (US); Gavin Patrick Abramson, Victor, NY (US)

(73) Assignee: GREENSTAR TECHNOLOGIES, LLC, Victor, NY (US)

( * ) Notice: Subject to any disclaimer, the term of this patent is extended or adjusted under 35 U.S.C. 154(b) by 0 days.

(21) Appl. No.: 14/259,986

(22) Filed: Apr. 23, 2014

(65) Prior Publication Data

US 2015/0052818 A1 Feb. 26, 2015

Related U.S. Application Data

(63) Continuation of application No. 13/155,382, filed on Jun. 7, 2011, now abandoned.

(51) Int. Cl.
*E06B 7/16* (2006.01)
*E06B 3/44* (2006.01)
(Continued)

(52) U.S. Cl.
CPC ..... *E06B 7/16* (2013.01); *E06B 1/70* (2013.01); *E06B 3/4415* (2013.01); *E06B 7/02* (2013.01);
(Continued)

(58) Field of Classification Search
CPC . E06B 3/4415; E06B 7/02; E06B 7/16; E06B 7/2305; E05D 15/22
(Continued)

(56) References Cited

U.S. PATENT DOCUMENTS 2,044,916 A 6/1936 Neumuth
2,778,068 A 1/1957 Kaufman et al.
(Continued)

FOREIGN PATENT DOCUMENTS

WO 2008119968 A2 10/2008

OTHER PUBLICATIONS

U.S. Non-Final Office Action dated Nov. 27, 2015 for U.S. Appl. No. 14/667,811 entitled "Draft Guard for Window Assembly Having Seals and Integral Fins".
(Continued)

*Primary Examiner* — Jerry E Redman
(74) *Attorney, Agent, or Firm* — Howard & Howard Attorneys PLLC

(57) ABSTRACT

A draft guard balancer is provided that attaches to, or is otherwise mechanically coupled to, or an integral part of, an existing balance shoe or balancer for a fenestration product such as a double hung window. The draft guard balancer creates a weatherstop along the track of the fenestration product that resists air, water, dirt, dust, pollen, and insects from entering the track and then the building. The draft guard balancer may be used with a balancer having a variety of springs, spring assemblies, balancer shoes and pivot bar arrangements. The draft guard balancer creates a seal that also prevents the increased friction that results from dirt and debris entering the track, thus making for a more energy efficient, easier to operate fenestration product. The draft guard balancer is equally applicable to both top and bottom sashes of a double hung window as well as other fenestration products.

22 Claims, 8 Drawing Sheets

(51) Int. Cl.
*E06B 7/26* (2006.01)
*E06B 1/70* (2006.01)
*E06B 7/02* (2006.01)
*E06B 7/23* (2006.01)

(52) U.S. Cl.
CPC ..... *E06B 7/2305* (2013.01); *E06B 7/26* (2013.01); *Y10T 16/64* (2015.01)

(58) Field of Classification Search
USPC ..... 49/181, 176, 445, 447
See application file for complete search history.

(56) References Cited

U.S. PATENT DOCUMENTS 3,055,063 A 9/1962 Peters
3,157,917 A 11/1964 Peters
3,434,236 A 3/1969 Weidner et al.
3,482,354 A * 12/1969 Trout ..... E06B 3/50 49/181
3,524,282 A * 8/1970 Kraft ..... E06B 3/44 49/181
4,134,402 A 1/1979 Mahurkar
4,170,090 A * 10/1979 Wood ..... E05D 13/1207 49/176
4,363,190 A 12/1982 Anderson
4,403,983 A 9/1983 Edelman et al.
4,563,170 A 1/1986 Aigner
4,568,329 A 2/1986 Mahurkar
4,583,968 A 4/1986 Mahurkar
4,623,327 A 11/1986 Mahurkar
4,785,581 A * 11/1988 Abramson ..... E05D 15/22 49/176
4,808,155 A 2/1989 Mahurkar
4,888,915 A 12/1989 Goldenberg
4,895,561 A 1/1990 Mahurkar
4,926,524 A * 5/1990 Owens ..... E05D 15/22 16/386
4,985,014 A 1/1991 Orejola
5,036,622 A 8/1991 Stark
5,053,023 A 10/1991 Martin
5,069,001 A 12/1991 Makarowski
5,117,586 A * 6/1992 Stark ..... E05D 13/08 49/429
5,168,665 A 12/1992 Goldenberg
5,174,064 A 12/1992 Stark, IV
5,197,951 A 3/1993 Mahurkar
5,221,255 A 6/1993 Mahurkar
5,237,775 A * 8/1993 Hardy ..... E05D 15/22 49/181
5,380,276 A 1/1995 Miller et al.
5,406,749 A 4/1995 Goldenberg
5,425,724 A 6/1995 Akins
5,444,790 A 8/1995 Kogen
5,451,207 A 9/1995 Yock
5,566,507 A * 10/1996 Schmidt ..... E05D 13/08 49/181
5,571,093 A 11/1996 Cruz et al.
5,584,803 A 12/1996 Stevens et al.
5,657,579 A 8/1997 Bruchu et al.
5,661,927 A * 9/1997 Polowinczak ..... E05D 13/1276 49/446
5,669,180 A * 9/1997 Maier ..... E05D 13/08 49/176
5,697,905 A 12/1997 d'Ambrosio
5,718,692 A 2/1998 Schon et al.
5,807,311 A 9/1998 Palestrant
5,868,717 A 2/1999 Prosl
5,927,014 A 7/1999 Goldenberg
6,099,506 A 8/2000 Macoviak et al.
6,106,497 A 8/2000 Wang
6,178,695 B1 1/2001 Kornegay et al.
6,387,037 B1 5/2002 Bolling et al.
6,532,964 B2 3/2003 Aboul-Hosn et al.
6,550,184 B1 * 4/2003 O'Donnell et al. .... E05D 13/08 49/176
6,658,794 B1 * 12/2003 Hansel ..... E05D 13/08 49/176
6,689,149 B2 2/2004 Maahs
6,726,651 B1 4/2004 Robinson et al.
6,804,913 B2 10/2004 Pipin
6,827,701 B2 12/2004 MacMahon et al.
6,926,662 B1 8/2005 Aboul-Hosn et al.
6,966,886 B2 11/2005 Appling
7,048,680 B2 5/2006 Viole et al.
7,069,621 B2 7/2006 Malek
7,076,835 B2 7/2006 Harold et al.
7,088,395 B2 8/2006 Takayama et al.
7,223,254 B2 5/2007 Hjalmarsson
7,282,041 B2 10/2007 Igarashi et al.
7,294,117 B2 11/2007 Provost-tine et al.
7,465,286 B2 12/2008 Patterson et al.
7,470,363 B2 12/2008 Milo
7,552,562 B2 6/2009 Curtis et al.
7,608,063 B2 10/2009 Le et al.
7,615,034 B2 11/2009 DiFiore
7,726,073 B2 6/2010 Ifko
7,753,868 B2 7/2010 Hoffa
7,833,157 B2 11/2010 Gottlieb et al.
8,066,660 B2 11/2011 Gregersen et al.
8,075,510 B2 12/2011 Aklog et al.
8,092,415 B2 1/2012 Moehle et al.
8,172,792 B2 5/2012 Wang et al.
8,198,210 B2 6/2012 Gadkaree et al.
8,337,451 B2 12/2012 Lareau et al.
8,435,204 B2 5/2013 Lad et al.
8,505,242 B1 * 8/2013 Kunz ..... E05D 13/1276 16/197
8,523,757 B2 9/2013 Taub et al.
9,181,748 B2 11/2015 Sofianek et al.
2001/0020160 A1 9/2001 Esch et al.
2002/0111583 A1 8/2002 Wright
2002/0138031 A1 9/2002 Ross
2003/0145523 A1 * 8/2003 Annes ..... E05D 13/08 49/181
2003/0221561 A1 12/2003 Milo
2004/0206002 A1 * 10/2004 Kunz ..... E05D 13/08 49/181
2004/0206003 A1 * 10/2004 Kunz ..... E05D 13/08 49/181
2004/0210180 A1 10/2004 Altman
2005/0004504 A1 1/2005 Frye et al.
2005/0182352 A1 8/2005 DiMatteo et al.
2006/0225362 A1 * 10/2006 Pettit ..... E05C 1/10 49/445
2006/0230682 A1 * 10/2006 Ifko ..... E05D 15/22 49/181
2007/0056216 A1 3/2007 Liang et al.
2007/0101654 A1 * 5/2007 Robertson ..... E05D 13/1276 49/445
2007/0113479 A1 * 5/2007 Uken ..... E05D 13/08 49/181
2007/0256462 A1 * 11/2007 VerSteeg ..... E05D 7/1044 70/90
2008/0047099 A1 2/2008 Malek
2008/0116707 A1 5/2008 Boaz et al.
2009/0064589 A1 3/2009 Tyler
2009/0157051 A1 6/2009 Appling et al.
2011/0105984 A1 5/2011 Patel et al.
2011/0106135 A1 5/2011 Thompson et al.
2012/0088955 A1 4/2012 Taub et al.
2013/0046224 A1 2/2013 Ravenscroft et al.
2013/0274643 A1 10/2013 Taub et al.
2013/0289527 A1 10/2013 Ravenscroft
2014/0024998 A1 1/2014 Prosl et al.
2014/0041309 A1 * 2/2014 Sofianek ..... E06B 7/16 49/424

(56) References Cited

U.S. PATENT DOCUMENTS

| | | | | |
|---|---|---|---|---|
| 2014/0230331 | A1* | 8/2014 | Kellum, III | E05D 13/06 49/352 |
| 2015/0197980 | A1 | 7/2015 | Abramson et al. | |

OTHER PUBLICATIONS

Canadian Office Action dated Mar. 22, 2017, Canadian Application No. 2,925,153, 3 Pages.
Final Office Action dated Dec. 2, 2016 for Utility U.S. Appl. No. 14/667,811.
Office Action of U.S. Appl. No. 14/667,811, dated Oct. 12, 2017; 11 pages.

* cited by examiner

DRAFT GUARD

BACKGROUND OF THE INVENTION

1. Field of the Invention

This application relates generally to window components, and more particularly to a draft guard window balancer system.

2. Description of Related Art

Fenestration products, such as windows and doors, clearly benefit from weather barriers such as weatherstripping as well as sound and tight fitting interrelational parts and components. Such weather barriers serve not only to prevent drafts, but also deter moisture entry as well as insect, dust and pollen infiltration. Over the years, energy efficiency standards as well as an overall awareness of the environmental benefits of energy efficient fenestration products have furthered the demand for proper and improved weather barriers, seals, and fittings. Many improved weatherstripping products now exist to perimeter seal windows and doors. While perimeter weatherstrips are necessary and highly beneficial, there are small openings in windows and doors that, without proper seals, can leak air, water, dust, pollen or even insects into the interior airspace of a building. Often these small openings are due to an interoperable mechanical arrangement that may be difficult to seal off without impacting the mechanical functionality between attendant components. One example of such a situation is that of the ever popular double hung window. A double hung window commonly has two sashes that travel vertically in a tracked frame. A spring assembly is often utilized to facilitate ease of vertical travel of each sash. Oftentimes, a pivot bar inserts into a balancer shoe which connects to a spring assembly to allow a sash to tilt out for cleaning. The use of a tracked frame and a traveling sash setup, while practical, creates a break in the weather barrier of the window that allows air, dust, pollen, moisture, or even insects, to travel up the track and into the building. In a strong wind, the track may even create a chimney effect where cold outside air is forced up the track and into the building through the meeting rail and sill areas. Since the sashes and related components move in the track, it has been difficult to properly weather seal this area of a double hung window. It is therefore an object of the present invention to provide a draft guard that seals the track of a double hung window from environmental factors. It is another object of the present invention to provide a draft guard that travels with a moveable window sash in a double hung window. It is another object of the present invention to provide a draft guard that works in conjunction with a pivoting sash arrangement for a double hung window. It is yet another object of the present invention to provide a draft guard that does not interfere with normal usage movement of a sash in a double hung window. It is a further object of the present invention to provide a window balancer with a draft guard. It is yet another object of the present invention to provide a method of manufacturing a double hung window.

These and other objects of the present invention will be further brought to light upon reading this specification and claims and viewing the attached drawings.

BRIEF SUMMARY OF THE INVENTION

In accordance with the present invention, there is provided a draft guard for a window balancer comprising a vertical component having a first edge, a second edge, a third edge and a fourth edge; a horizontal component having a first edge, a second edge, a third edge and a fourth edge; the second edge of the horizontal component being joined to the second edge of the vertical component at a generally right angle; the horizontal component further having a first cut and a second cut in proximity to and generally parallel to the second edge; and the vertical component having a pivot bar hole.

The foregoing paragraph has been provided by way of introduction, and is not intended to limit the scope of the invention as described by this specification, claims, and the attached drawings.

BRIEF DESCRIPTION OF THE DRAWINGS

The invention will be described by reference to the following drawings, in which like numerals refer to like elements, and in which.

The present invention will be described in connection with several preferred embodiments; however, it will be understood that there is no intent to limit the invention to the embodiments described. On the contrary, the intent is to cover all alternatives, modifications, and equivalents as may be included within the spirit and scope of the invention as defined by this specification, claims, and the attached drawings.

DESCRIPTION OF THE PREFERRED EMBODIMENTS

Balances or balancers, as used herein, describe the mechanical component or components that contain a spring or balance assembly that connects a window sash to a master frame to allow for ease of operation. While such balances or balancers are commonly used with double hung windows, other window arrangements may benefit from such hardware such as, for example, sliding windows. Windows may be wood, vinyl, aluminum, fiberglass, or the like. A window balancer configuration allows a window sash to be tilted in a plane outside its normal operating plane to allow for cleaning.

The present invention solves the problem of a draft or chimney effect originating from the hollow chamber tracks in a window frame and the space between a sash and master frame, by adding a draft guard component to a balance or balancer. The draft guard mechanically attaches to a constant force balancer and the balancer pivot bar at the balancer shoe of a block and tackle balancer or a spiral balancer. The present invention includes not only the draft guard, but a balance or balancer having a draft guard, along with a method of manufacturing fenestration products that have a draft guard. In addition, the present invention includes modifications, variations, additions, improvements and enhancements to the present invention that will be known or contemplated after reading this specification and the accompanying drawings.

Figure 1:
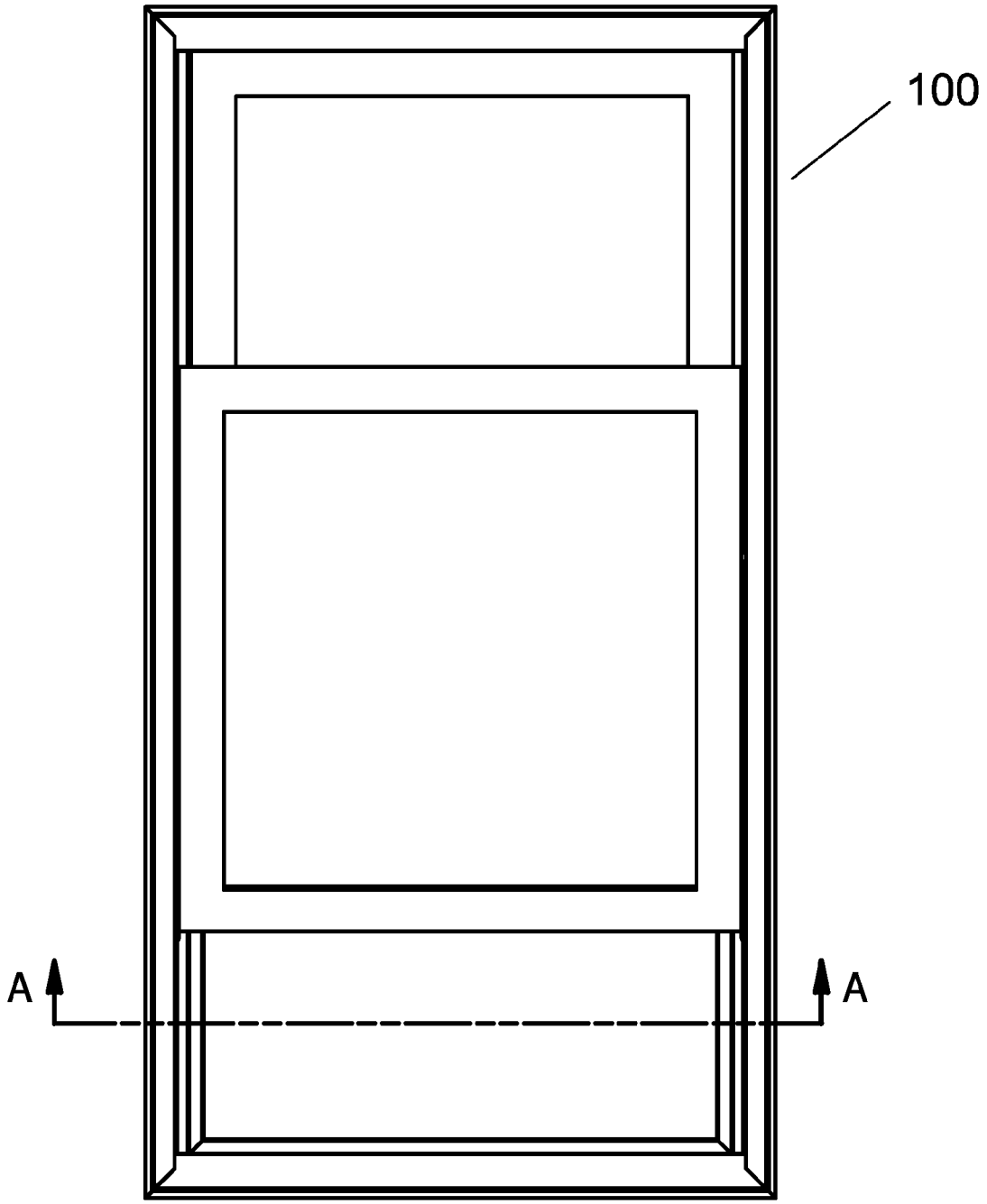
FIG. 1 is a plan view of a double hung window with cut line A-A.
Figure 2:
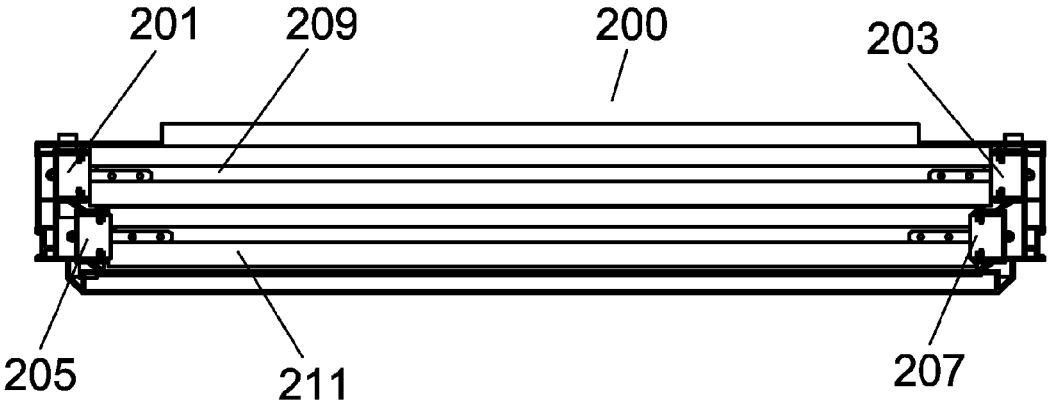
FIG. 2 is a cutaway view of the double hung window taken along cut line A-A of FIG. 1.

For a better understanding of the present invention and the various embodiments described and envisioned herein, a double hung window is depicted in FIGS. 1 and 2. While arguably the most common application of the present invention, applicability is not limited to double hung windows, but the present invention may find suitable and useful applications in other fenestration products as well.

FIG. 1 is a plan view of a double hung window 100 with cut line A-A. Two window sashes can be seen contained by a tracked frame. The tracks are contained in the frame and make contact with the two vertical edges of each window sash. It is within these tracks that a balancer, spring and draft guard are contained. This arrangement can be better seen in FIG. 2, which is a cutaway view 200 of the double hung window taken along cut line A-A of FIG. 1. The window extrusion chamber hollows can be clearly seen in this cutaway view. A first sash 209 and a second sash 211 can be seen in FIG. 2. In addition, four draft guards can be seen, two per sash. A first draft guard 201 and a second draft guard 203 can be seen at either end of the first sash 209. In a similar arrangement, a third draft guard 205 and a fourth draft guard 207 can also be seen at either end of the second sash 211. The draft guards visible in FIG. 2 are attached to the bottom of a balancer arrangement that is also in use, but cannot be clearly seen in FIG. 2. The balancer arrangement provides mechanical connectivity between the moveable sash and the fixed master frame, with a spring or balance assembly there between for ease of operation. The details of such an arrangement will be further described by way of the remaining figures.

Figure 3:
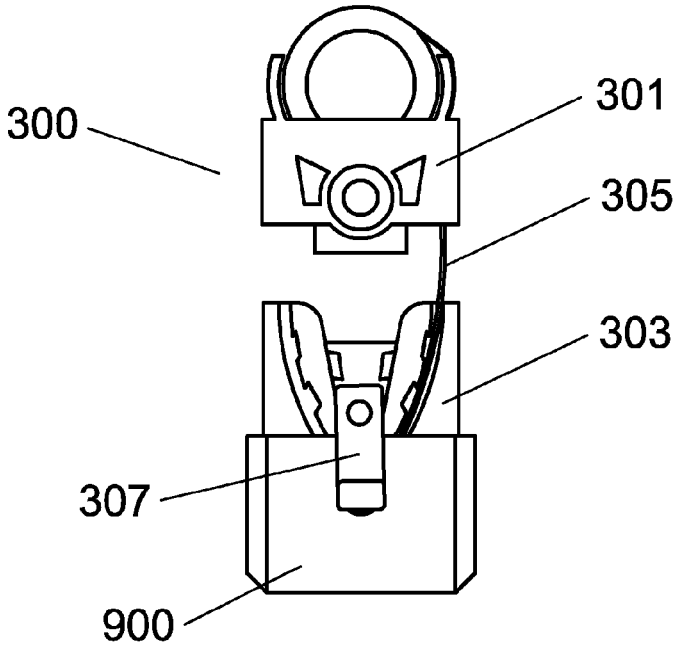
FIG. 3 is a front plan view of a balancer showing the draft guard in use.
Figure 4:
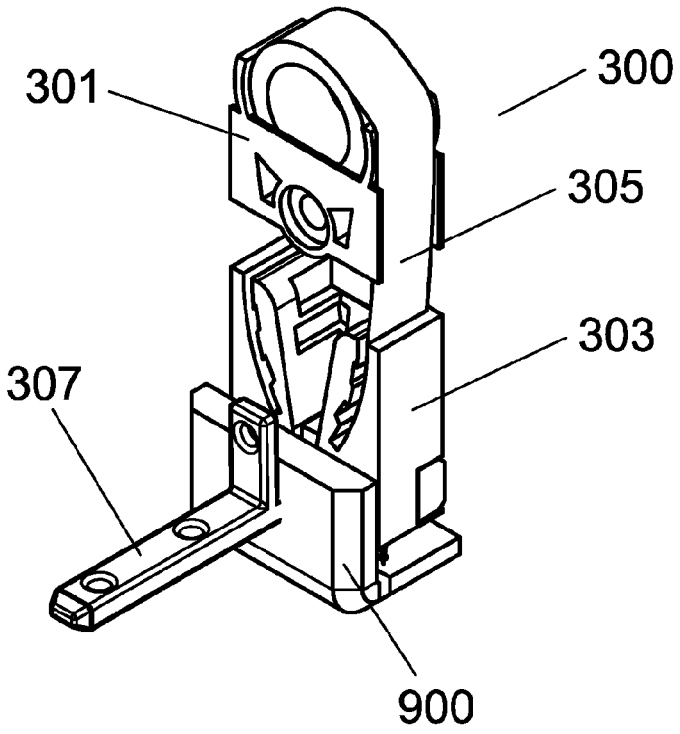
FIG. 4 is a perspective view of a balancer showing the draft guard in use.
Figure 5:
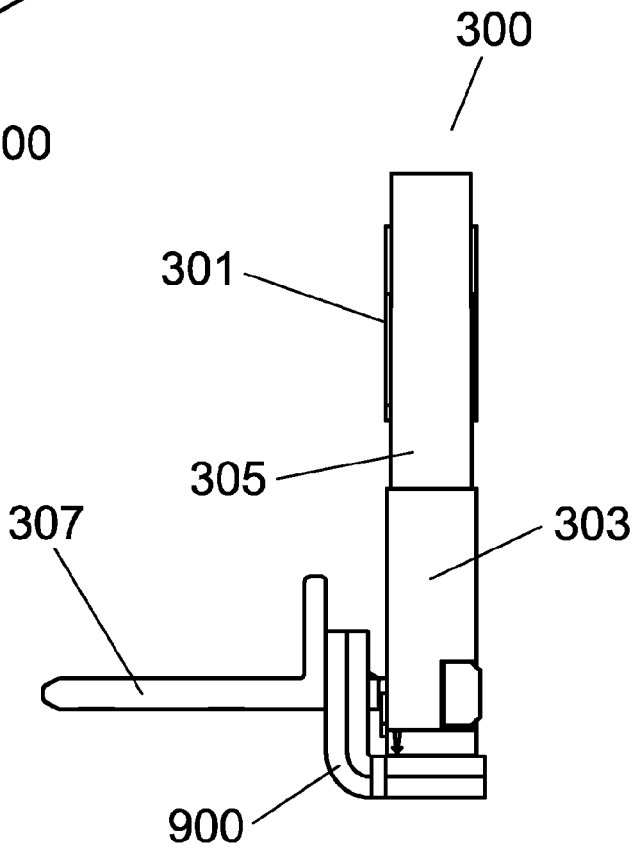
FIG. 5 is a right side view of a balancer showing the draft guard in use.
Figure 6:
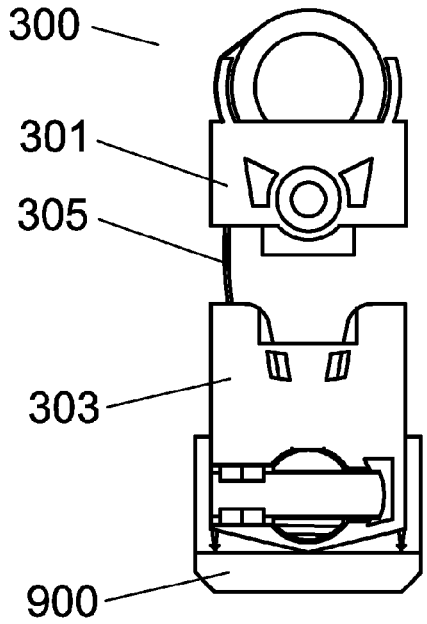
FIG. 6 is a rear plan view of a balancer showing the draft guard in use.
Figure 7:
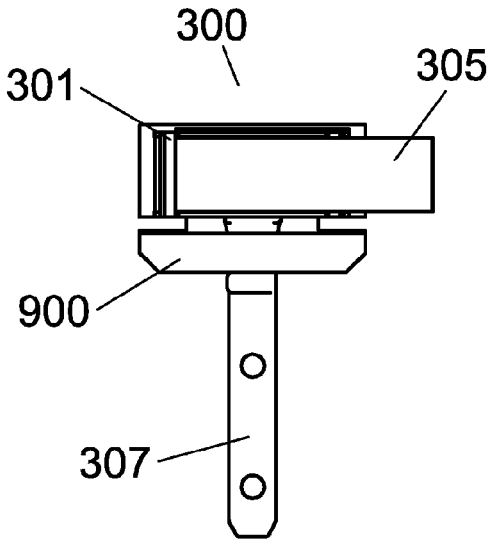
FIG. 7 is a top plan view of a balancer showing the draft guard in use.
Figure 8:
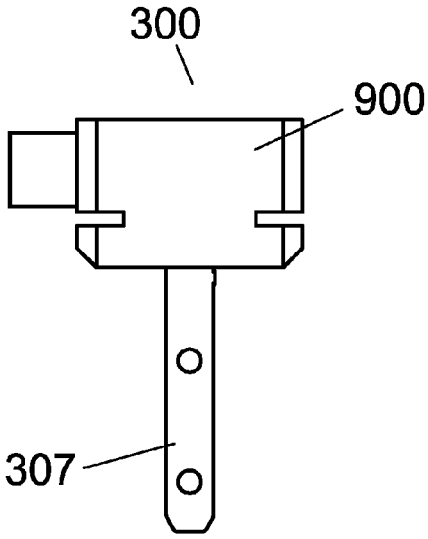
FIG. 8 is a bottom plan view of a balancer showing the draft guard in use.

FIGS. 3-8 depict a balancer system showing the draft guard in use. FIG. 3 is a front plan view of a balancer and pivot bar 300 showing the draft guard in use. The upper structure in FIG. 3 is the frame side of the balancer 301 and the lower structure in FIG. 3 is the sash side of the balancer 303. The pivot bar 307 inserts into the shoe of the sash side of the balancer 303. The frame side of the balancer 301 and the sash side of the balancer 303 may be made from a plastic such as polypropylene, nylon or the like, or from a metal such as aluminum. Preferentially, a material with a low coefficient of friction should be used to provide smooth operation. Various plastics fall into this category. The frame side of the balancer 301 and the sash side of the balancer 303 may be injection molded, or machined, for example. Between the frame side of the balancer 301 and the sash side of the balancer 303 is a spring 305. The spring 305 may be a constant force spring made from, for example, flat stock and wound steel or stainless steel. The spring may also be a spiral spring or a block and tackle spring assembly, and may contain a separate balancer shoe not directly attached to a spring housing. Further depicted in FIG. 2 is a pivot bar 307. The pivot bar 307 can be better seen in FIG. 4. The pivot bar 307 is typically made from a metal such as steel, and may be coated, painted or galvanized for rust prevention. The pivot bar 307 is cast, machined or stamped and retains the bottom edge of a window sash connecting directly to a balancer shoe. The figures depict a three hole arrangement for placing screws through the pivot bar 307. Other configurations, such as two holes, one hole, four holes, and the like, and other fasteners may, in some embodiments of the present invention, be used. The pivot bar 307 may, in some embodiments of the present invention, pivot to allow the attached window sash to tilt for cleaning. In some embodiments, the pivot bar engages with a balancer shoe cam that in turn pushes a tab outward to create friction against the track that the balancer shoe rides in, thus allowing the window sash to be tilted for cleaning while maintaining a fixed position in the track. Connected to the balancer and pivot bar is a draft guard 900. FIGS. 9-16 will depict the draft guard removed from the balancer and pivot bar. The draft guard 900 is attached to the pivot bar and attaches to the balancer with an adhesive, a barbed fastener, a rivet, a snap, a mechanical connecting guide, a hook and loop fastener, or the like. Mechanical coupling of the draft guard 900 is to the sash side of the balancer. The placement of the draft guard 900, in use, prevents air, water, dirt, pollen, or insect infiltration up the track and into the building. In addition, the draft guard 900 prevents dirt and debris from entering the track and creating unnecessary friction. In use, the draft guard 900 is bent along and makes contact with surfaces of the window assembly to provide enhanced and improved sealing. A full complement of views of the balancer 300 and draft guard 900 is conveyed by way of FIGS. 4-8. FIG. 4 is a perspective view of a balancer and pivot bar 300 showing the draft guard 900 in use. FIG. 5 is a right side view of a balancer 300 showing the draft guard 900 in use. FIG. 6 is a rear plan view of a balancer 300 showing the draft guard 900 in use. FIG. 7 is a top plan view of a balancer 300 showing the draft guard 900 in use. FIG. 8 is a bottom plan view of a balancer 300 showing the draft guard 900 in use and also showing the pivot bar in place.

Figure 9:
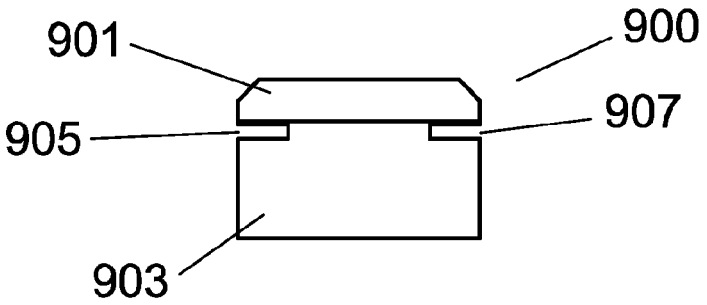
FIG. 9 is a top plan view of the draft guard.

FIGS. 9-16 depict the draft guard 900 removed from the balancer. The draft guard 900 is made from a weatherstopping material such as, for example, ethylene propylene diene monomer (EPDM) rubber, and extruded, die cut, or the like. Other materials that may be used to make the draft guard 900 are thermoplastic elastomers (TPE) that may be extruded, injection molded, die cut, or the like. Another material that may be used to make the draft guard 900 is thermoplastic polyolefin (TPO) and may be processed by injection molding, extruded, thermoformed, die cut, or the like. Other examples of materials that may be used to make the draft guard 900 include polystyrene, foam rubber, silicone, closed cell foam, felt, and the like. Materials used to make the draft guard 900 may also, in some embodiments of the present invention, be treated with an antimicrobial chemical to reduce mold, mildew and degradation related to other organism. An example of such treatment is disclosed in U.S. Pat. No. 5,681,637 to Kessler and Abramson and entitled Microorganism Resistant Pile Weatherstripping, the entire disclosure of which is incorporated herein by reference. FIG. 9 is a top plan view of the draft guard 900. The draft guard 900 comprises a vertical component and a horizontal component.

Figure 10:
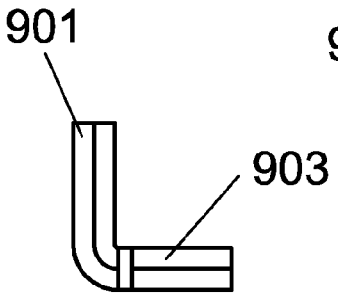
FIG. 10 is a left side view of the draft guard.
Figure 11:
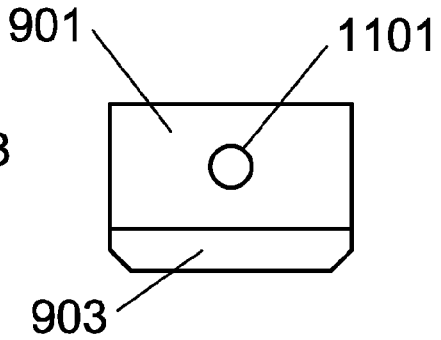
FIG. 11 is a front plan view of the draft guard.
Figure 12:
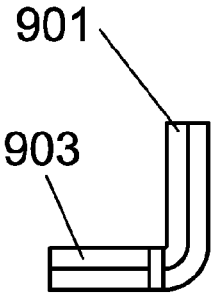
FIG. 12 is a right side view of the draft guard.
Figure 13:
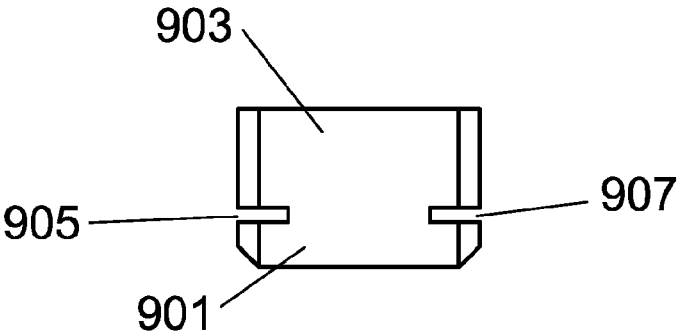
FIG. 13 is a bottom plan view of the draft guard.
Figure 14:
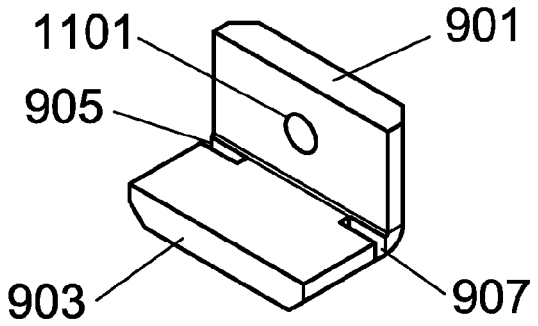
FIG. 14 is a perspective view of the draft guard.
Figure 15:
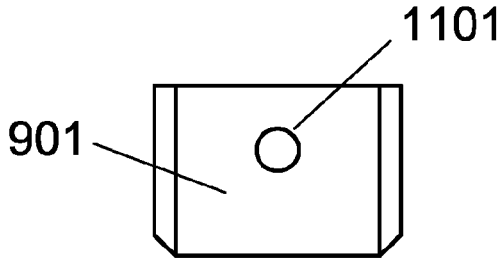
FIG. 15 is a rear plan view of the draft guard.
Figure 16:
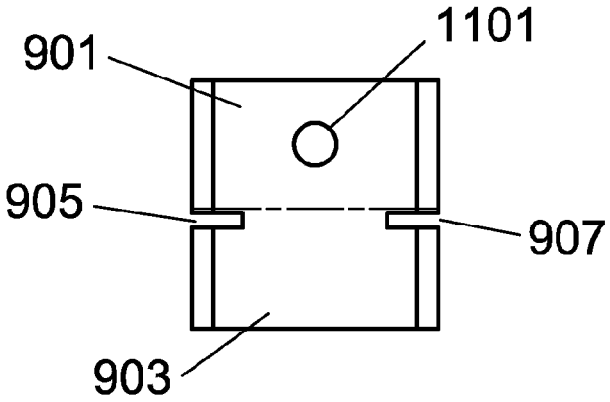
FIG. 16 is a flattened plan view of the draft guard.

The vertical component 901 has a generally rectangular shape and has a first edge, a second edge, a third edge and a fourth edge. The vertical component 901 can be more clearly seen in FIG. 14. The vertical component 901 has a pivot bar hole 1101 that can be seen in FIG. 14 to accommodate the pivot bar which in turn attaches to the balancer shoe area of a balancer. (not shown in FIG. 9, see FIG. 4). The vertical component 901 is joined to horizontal component 903 at a generally right angle. The horizontal component 903 has a generally rectangular shape and has a first edge, a second edge, a third edge and a fourth edge. The horizontal component 903 further has a first cut 905 and a second cut 907 in proximity to and generally parallel to the second edge. Various embodiments of the draft guard of the present invention may have varying cuts, thicknesses, shapes, and materials that are based, for example, on specifications of the window. In some embodiments the vertical component 901 and the horizontal component 903 are made from a single material and may be formed as one part. Processes to allow the horizontal component 903 and the vertical component 901 to be formed as one part include, but are not limited, to, injection molding, extruding, and the like. FIG. 10 is a left side view of the draft guard 900. FIG. 11 is a front plan view of the draft guard 900. The pivot bar hole 1101 can be clearly seen. The pivot bar hole 1101 accommodates the pivot bar of the balancer shoe (not shown in FIG. 11, see FIG. 4). In some embodiments, the pivot bar hole 1101 may be round, oval, square, rectangular, octagonal, or of another geometry that allows a pivot bar to pass freely. FIG. 12 is a right side view of the draft guard 900. FIG. 13 is a bottom plan view of the draft guard 900. In some embodiments of the present invention, the first and third edges of the horizontal component are beveled. As well, the first and third edges of the vertical component may also be beveled. The bevel may be a 45 degree bevel, or may be of some other angle, or may be a roundover with any radius useful in reducing the sharp angle of the edge and thus provide ease of operation and reduced friction in use. FIG. 14 is a perspective view of the draft guard 900 that clearly shows the orientation of the vertical and horizontal components and the attributes associated with each. FIG. 15 is a rear plan view of the draft guard 900. FIG. 16 is a flattened plan view of the draft guard that clearly shows both the horizontal and the vertical component. A dotted line indicates the fold line of the draft guard. In some embodiments of the present invention, the draft guard may be flat as shown in FIG. 16 prior to assembly and attachment to a pivot bar and balancer. In other embodiments of the present invention, the balancer may be molded or otherwise fabricated with a generally right angle already intrinsic in the draft guard, as shown, for example, in FIG. 14.

Figure 17:
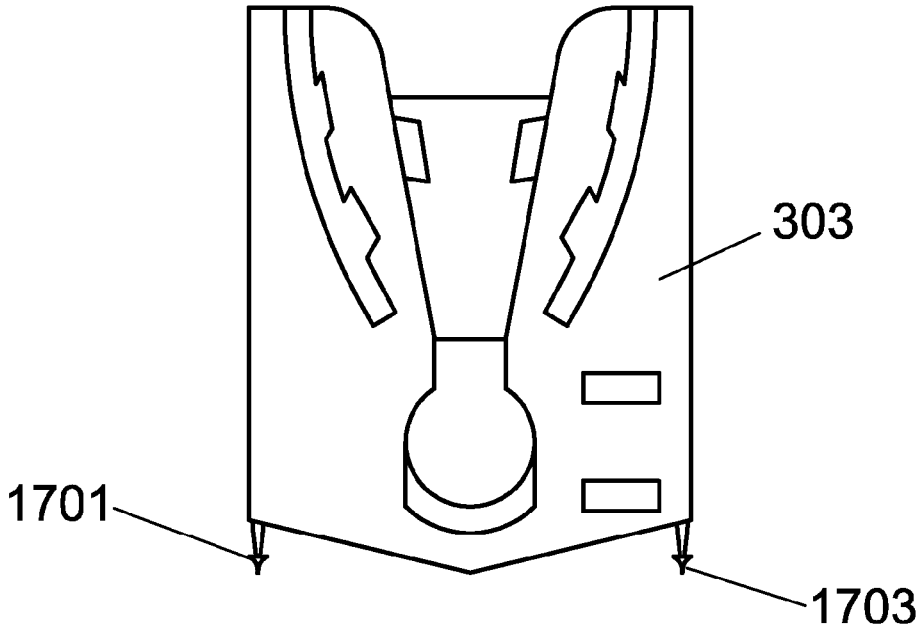
FIG. 17 is a plan view of the sash side of the balancer shoe.
Figure 18:
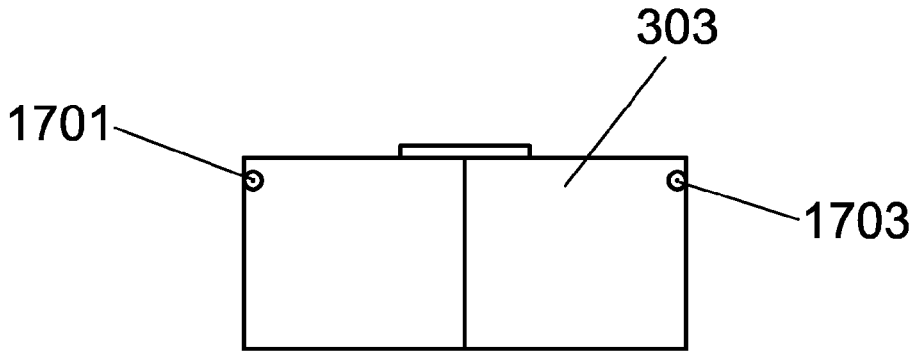
FIG. 18 is a bottom plan view of the sash side of the balancer shoe.
Figure 19:
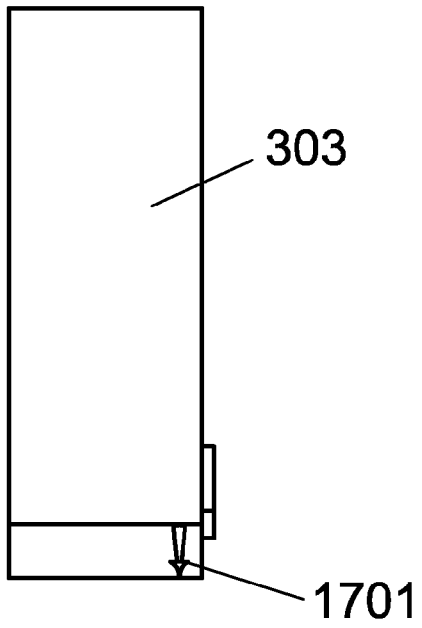
FIG. 19 is a left side view of the sash side of the balancer shoe.
Figure 20:
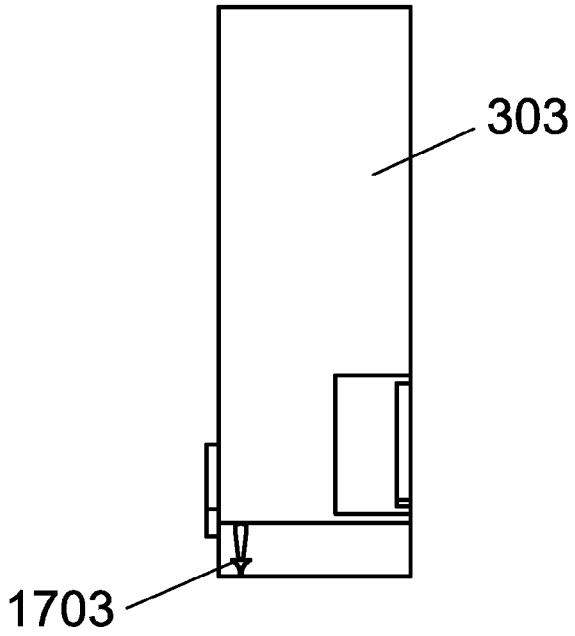
FIG. 20 is a right side view of the sash side of the balancer shoe.

Lastly, FIGS. 17-20 depict a constant force balancer with an exemplary mechanical coupling arrangement for coupling the draft guard (not shown in FIGS. 17-20, see previous figures) to the sash side of the balancer. The example in FIGS. 17-20 is not to be considered limiting. Adhesives, rivets, snaps, mechanical connecting guides, hook and loop fasteners, and other devices and techniques may be used alone or in combination to attach the draft guard to the balancer. FIG. 17 is a plan view of the sash side of the constant force balancer 300 showing an example of the use of a first fastener 1701 and a second fastener 1703 to retain the draft guard to the balancer. The first fastener 1701 and the second fastener 1703 are barbs that may be molded into the sash side of the balancer 303 or may be metal barbs that are inserted into the sash side of the balancer 303 as a secondary operation. These barbs are also shown in FIG. 18 as a bottom plan view of the sash side of the balancer. FIG. 19 is a left side view of the sash side of the balancer and FIG. 20 is a right side view of the sash side of the balancer. Each of FIGS. 17-20 depicts an example of a mechanical coupling fastening technique. Other techniques may be used alone or in combination. The draft guard will, however, be fastened securely to the sash side of the balancer and pivot bar.

The draft guard is used in a fenestration product such as a double hung window. It may be incorporated into the fenestration product during manufacture and assembly, or may, in some embodiments of the present invention, be added to an existing fenestration product either by fastening the draft guard to an existing balancer or balancer shoe, or replacing the balancer with a new balancer or new balancer shoe having a draft guard. To manufacture a double hung window using the present invention, a sash side of the balancer and pivot bar having a draft guard is attached to a first sash, a frame side of a balancer is attached to a double hung window frame, the first sash is installed in the double hung window frame, and a spring is connected between the sash side of the balancer having a draft guard and the frame side of the balancer. Modifications and variations to this manufacturing process may also be contemplated after reading this specification and viewing the attached drawings.

It is, therefore, apparent that there has been provided, in accordance with the various objects of the present invention, a draft guard for a balancer. While the various objects of this invention have been described in conjunction with preferred embodiments thereof, it is evident that many alternatives, modifications, and variations will be apparent to those skilled in the art. Accordingly, it is intended to embrace all such alternatives, modifications and variations that fall within the spirit and broad scope of the present invention as defined by this specification, claims and the attached drawings.

What is claimed is:

1. A window balancer comprising:

a frame side component;

a sash side component defining a component width and a component depth;

a spring connecting the frame side component to the sash side component; and a draft guard mechanically coupled to the sash side component, wherein the draft guard comprises a horizontal portion and a vertical portion at a generally right angle to the horizontal portion to form a corner therebetween;

wherein the horizontal portion of the draft guard extends along a bottom of the sash side component and the vertical portion extends along a side of the sash side component; and wherein the horizontal portion defines a draft guard width greater than the component width, and defines a draft guard depth greater than the component depth.

2. The balancer of claim 1, wherein the vertical portion and the horizontal portion are comprised of a single material.

3. The balancer of claim 1, wherein the vertical portion and the horizontal portion are made from a closed cell foam.

4. The balancer of claim 1, wherein the vertical portion and the horizontal portion are made from a felt.

5. The balancer of claim 1, wherein the vertical portion and the horizontal portion are made from a polypropylene non-woven fabric.

6. The balancer of claim 1, wherein the vertical portion and the horizontal portion are made from a foam rubber.

7. The balancer of claim 1, wherein the vertical portion and the horizontal portion are made from a silicone.

8. The balancer of claim 1, wherein the spring is a constant force spring.

9. The balancer of claim 1, wherein the spring is a spiral spring.

10. The balancer of claim 1, wherein the draft guard is mechanically coupled to the sash side component with an adhesive.

11. The balancer of claim 1, wherein the draft guard is mechanically coupled to the sash side component with a barb.

12. The balancer of claim 1, wherein the draft guard is mechanically coupled to the sash side component with a hook and loop fastener.

13. The balancer of claim 1, wherein the draft guard is mechanically coupled to the sash side component with a mechanical connecting guide.

14. The balancer of claim 1, wherein the draft guard is mechanically coupled to the sash side component with a rivet.

15. The balancer of claim 1, wherein the draft guard is mechanically coupled to the sash side component with a snap.

16. A balancer as set forth in claim 1 wherein the vertical portion of the draft guard defines a second draft guard width greater than the component width.

17. A balancer as set forth in claim 16 where the draft guard width of the horizontal portion is the same as the second draft guard width of the vertical portion.

18. A window balancer comprising:

a frame side component;

a sash side component;

a spring connecting the frame side component to the sash side component;

a pivot bar inserted into the sash side component to allow pivoting of the sash side component about the pivot bar; and a draft guard coupled to the sash side component with the draft guard having a horizontal portion extending along a bottom of the sash side component and a vertical portion extending along a side of the side sash component;

wherein the vertical portion of the draft guard defines an opening with the pivot bar passing through the opening to permit the insertion of the pivot bar into the sash side component.

19. A window balancer as set forth in claim 18 wherein the horizontal portion and the vertical portion are at a generally right angle relative to each other.

20. A window balancer as set forth in claim 18 wherein the draft guard is made of a non-rigid material.

21. A window balancer as set forth in claim 18 wherein the opening in the vertical portion is further defined as a hole to permit insertion of the pivot bar.

22. A window balancer as set forth in claim 18 wherein the vertical portion and the horizontal portion are comprised of a single material.

* * * * *